US007513045B2

(12) United States Patent
Kain

(10) Patent No.: US 7,513,045 B2
(45) Date of Patent: Apr. 7, 2009

(54) FOLDING KNIFE WITH HANDLE PIVOTING MECHANISM

(75) Inventor: Charles Kain, Indianapolis, IN (US)

(73) Assignee: GB II Corporation, Tualatin, OR (US)

( * ) Notice: Subject to any disclaimer, the term of this patent is extended or adjusted under 35 U.S.C. 154(b) by 198 days.

(21) Appl. No.: 11/430,395

(22) Filed: May 8, 2006

(65) Prior Publication Data

US 2006/0248727 A1 Nov. 9, 2006

Related U.S. Application Data

(60) Provisional application No. 60/678,208, filed on May 6, 2005.

(51) Int. Cl.
*B26B 3/06* (2006.01)

(52) U.S. Cl. ..... 30/158; 30/151

(58) Field of Classification Search ..... 30/158, 30/330, 153, 156
See application file for complete search history.

(56) References Cited

U.S. PATENT DOCUMENTS

| | | | | |
|---|---|---|---|---|
| 825,093 | A | 7/1906 | Watson | |
| 1,495,449 | A | 5/1924 | Sibley | |
| 1,524,694 | A | 2/1925 | Di Maio | |
| 2,304,601 | A | 12/1942 | Schrade | |
| 2,952,912 | A | 9/1960 | Crawford | |
| 3,702,501 | A * | 11/1972 | Wood | 30/153 |
| 4,612,706 | A | 9/1986 | Yunes | |
| 4,744,272 | A | 5/1988 | Leatherman | |
| 4,974,323 | A | 12/1990 | Cassady | |
| 5,293,690 | A | 3/1994 | Cassady | |
| 5,331,741 | A | 7/1994 | Taylor, Jr. | |
| 5,357,678 | A | 10/1994 | Wei | |
| 5,979,065 | A | 11/1999 | Hsu | |
| 6,145,202 | A | 11/2000 | Onion | |
| 6,158,127 | A * | 12/2000 | Taylor | 30/158 |
| 6,273,582 | B1 | 8/2001 | Taggart et al. | |
| 6,289,592 | B1 | 9/2001 | Emerson | |
| 6,397,476 | B1 | 6/2002 | Onion | |

(Continued)

FOREIGN PATENT DOCUMENTS

CH 681518 A5 6/1990

OTHER PUBLICATIONS

Hawk Designs webpage, http://www.g-hawkknives.com/TOAD.html, "T.O.A.D.," 2 pages.
Hawk Designs webpage, http://www.g-hawkknives.com/ET.html, "E.T. Has Landed," 2 pages.
Hawk Designs webpage, http://www.g-hawkknives.com/images/ETHigh.jpg, "E.T.", 1 page.

(Continued)

*Primary Examiner*—Kenneth E. Peterson
*Assistant Examiner*—Sean Michalski
(74) *Attorney, Agent, or Firm*—Klarquist Sparkman, LLP

(57) ABSTRACT

A folding knife having a blade-opening mechanism incorporated in the handle of the knife. The blade-opening mechanism in one form can be used to pivot the blade from the closed position to the open position by manually applying pressure to the blade-opening mechanism rather than to a portion of the blade. The blade-opening mechanism in one embodiment also can be adapted to function as a closing mechanism for pivoting the blade closed without applying pressure to the blade. In particular embodiments, the handle desirably includes a pivotable side portion that is coupled to the tang portion of the blade such that manually pivoting the side portion is effective to cause pivoting movement of the blade.

19 Claims, 9 Drawing Sheets

U.S. PATENT DOCUMENTS

| | | | |
|---|---|---|---|
| 6,397,477 | B1 | 6/2002 | Collins |
| 6,477,777 | B1 | 11/2002 | Oliveri |
| 6,574,872 | B2 | 6/2003 | Roberts et al. |
| 6,711,820 | B2 | 3/2004 | Chen |

OTHER PUBLICATIONS

Hawk Designs webpage, http://www.g-hawkknives.com/images/toadDiagram.jpg, 1 page.

* cited by examiner

FOLDING KNIFE WITH HANDLE PIVOTING MECHANISM

CROSS REFERENCE TO RELATED APPLICATION

The present application claims the benefit of U.S. Provisional Application No. 60/678,208, filed May 6, 2005, which is incorporated herein by reference.

FIELD

The present disclosure relates generally to embodiments of a folding knife.

BACKGROUND

One form of conventional sport or work knives comprises a handle and one or more folding blades. The blades in such knives are closed or opened simply by applying pressure directly on the blade or an extension portion of the blade and rotating the blade to the desired position. For example, a typical conventional folding knife might have a thumb-stud or similar mechanism affixed directly to the blade to assist in pivoting the blade from the closed, or folded, position to the open position extending from the handle. Closing the blade typically requires releasing a blade locking mechanism and then applying pressure to the back of the blade and rotating it to the closed position. While some conventional folding knives can be opened or closed using only one hand, such one-handed operation can be awkward or difficult for individuals lacking the required dexterity.

It would be desirable to provide a folding knife with a novel blade-opening mechanism.

SUMMARY

In one aspect, the present disclosure concerns embodiments of a folding knife having a blade-opening mechanism incorporated in the handle of the knife.

The blade-opening mechanism in one form can be used to pivot the blade from the closed position to the open position by manually applying pressure to the blade-opening mechanism rather than to a portion of the blade. This allows the blade to be opened in this embodiment more easily using only one hand compared to some conventional folding knives. The blade-opening mechanism in one form also can be adapted to function as a closing mechanism for pivoting the blade closed without applying pressure to the blade.

In particular embodiments, the knife includes a pivotable side portion, which can be a side panel forming one side of the blade receiving channel in the handle, that is coupled to the tang portion of the blade such that pivoting the side portion causes corresponding pivoting movement of the blade. The side portion can be pivotable relative to the handle between a first position and a second position. Pivoting the side portion from the first position to the second position, for example by applying pressure to the side portion using one's thumb, is effective to cause the blade to pivot from the closed position to an intermediate position between the closed and open positions. In one embodiment, further pivoting of the side portion in the opposite direction from the second position back to the first position is desirably effective to further pivot the blade from the intermediate position to the open position.

To produce movement of the blade upon pivoting of the side portion, in one embodiment the side portion can be formed with a channel adjacent the tang portion of the blade.

A pin is affixed to or coupled to a side of the tang portion and extends laterally into the channel. The channel is shaped such that pivoting the side portion of the handle causes the pin to engage and move along an inner surface of the channel, which in turn causes the blade to pivot about its pivot axis. When the side portion of the handle is pivoted from the first position to the second position, the pin is moved from one end of the channel to an intermediate location within the channel, causing the blade to move to an intermediate position. When the side portion is pivoted back to the first position in this example, the pin is moved from the intermediate location to the opposite end of the channel, causing the blade to move to the open position.

In certain embodiments, the side portion of the handle also can be used to close the blade from the open position. To close the blade, in one example the side portion is pivoted from the first position to the second position, which causes the blade to pivot from the open position to the intermediate position. In one embodiment, the side portion can then be pivoted back to the first position, which causes the blade to pivot from the intermediate position to the closed position.

In one representative embodiment, a folding knife comprises a blade having a tang portion and a handle comprising a first handle portion and a second handle portion. The first handle portion is pivotally coupled to the second handle portion at a handle pivot for pivoting movement of the first handle portion relative to the second handle portion. The tang portion is pivotally coupled to the second handle portion at a blade pivot for pivoting movement of the blade between an open position and a closed position. The first handle portion is coupled to the blade such that pivoting movement of the first handle portion in a first direction causes movement of the blade from the closed position to a partially open position. In a representative embodiment, further pivoting movement of the first handle portion in a second direction, opposite the first direction, causes movement of the blade from the partially open position to the open position.

In another representative embodiment, a folding knife comprises a blade having a tang portion and a handle comprising a first handle portion and a second handle portion. The first handle portion is pivotally coupled to the second handle portion at a handle pivot for pivoting movement of the first handle portion relative to the second handle portion. The tang portion is pivotally coupled to the second handle portion at a blade pivot for pivoting movement of the blade between an open position and a closed position. The first handle portion is slidably coupled to the tang portion such that pivoting movement of the first handle portion relative to the second handle portion causes pivoting movement of the blade.

In another representative embodiment, a folding knife comprises a handle and a blade having a tang portion that is pivotally coupled to the handle for pivoting movement of the blade between an open position and a closed position. The handle comprises a first handle portion pivotally connected to the tang portion and a second handle portion that is pivotal relative to the first handle portion and in sliding contact with the tang portion. The knife also includes means for converting pivoting movement of the second handle portion relative to the first handle portion into pivoting movement of the blade.

In still another representative embodiment, a folding knife comprises a handle and a blade having a tang portion that is pivotally coupled to the handle for pivoting movement of the blade between an open position and a closed position. The handle comprises a pivotal blade-opening mechanism in sliding contact with the tang portion such that pivoting movement of the blade-opening mechanism produces pivoting movement of the blade toward the open position.

In yet another representative embodiment, a method of using a folding knife is provided. The knife comprises a handle, a blade pivotally coupled to the handle and operable to pivot relative to the handle between an open position and a folded, closed position. The method comprises manually pivoting a side panel of the handle relative to the blade to cause the blade to pivot. For example, in one embodiment, the side panel can be manually pivoted to pivot the blade from the closed position to the open position, or alternatively, to pivot the blade from the open position to the closed position.

The foregoing and other features and advantages of the invention will become more apparent from the following detailed description, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contains A or B or A and B, and optionally one or more other components such as C.

As used herein, the term "coupled" includes direct connection of one element to another element and indirect connection through one or more other elements.

Figure 1:
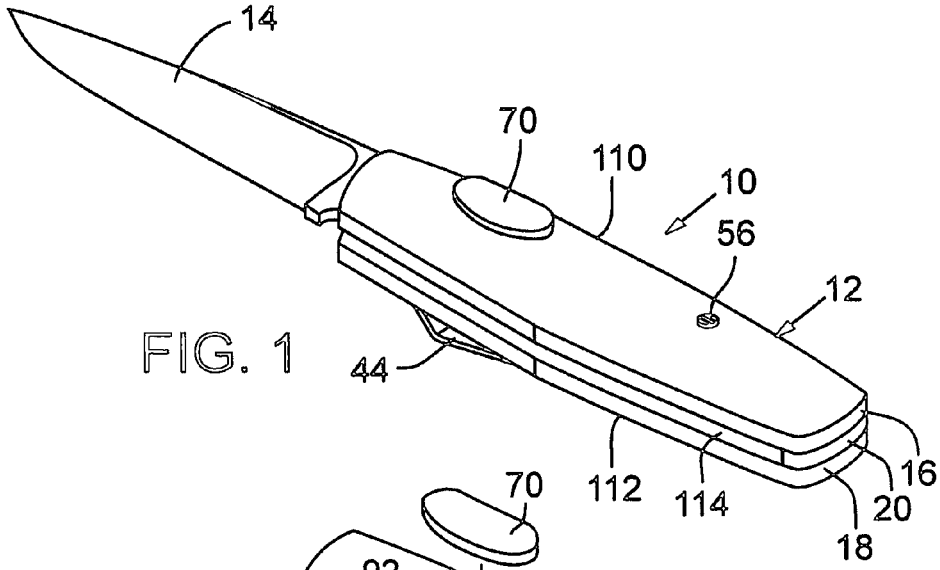
FIG. 1 is a perspective view of a folding knife shown with the blade in the open position, according to one embodiment.
Figure 2:
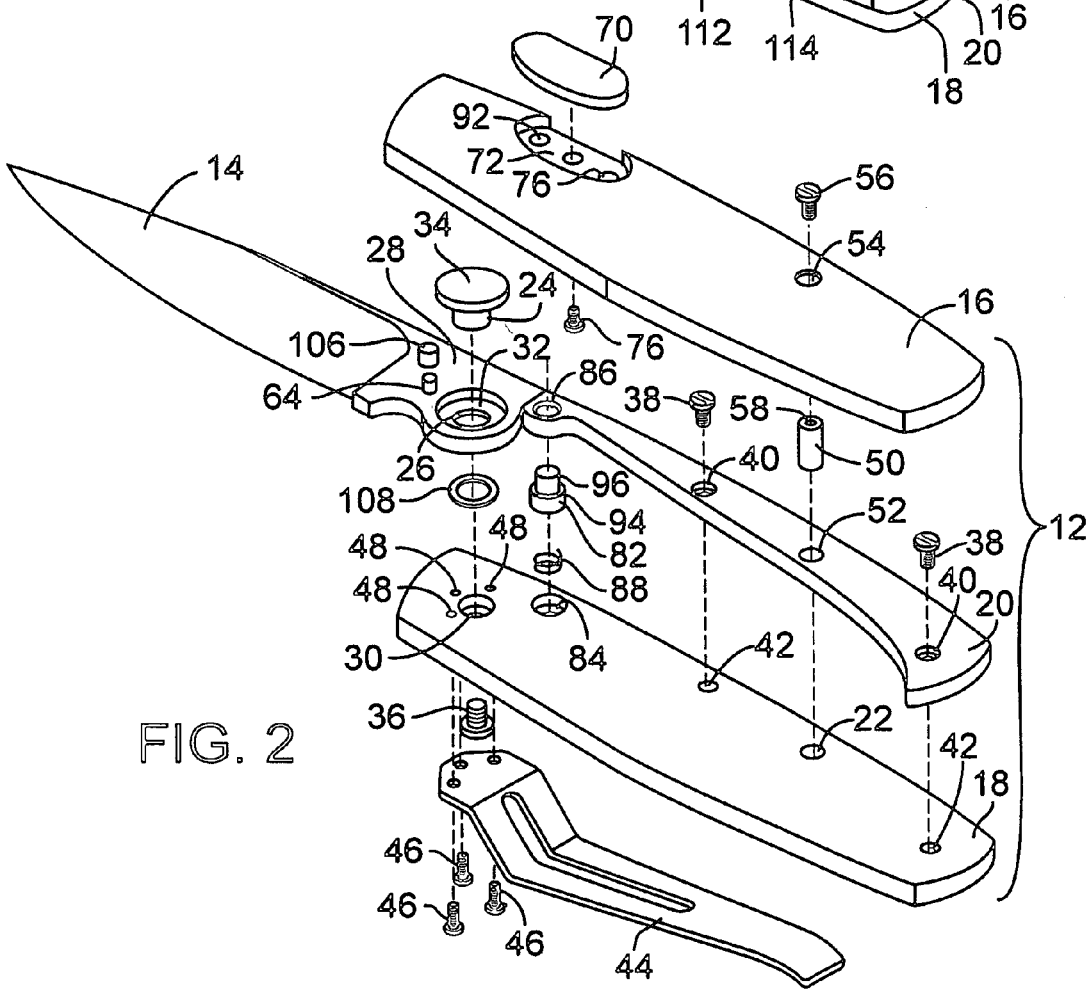
FIG. 2 is an exploded, perspective view of the knife of FIG. 1.

FIGS. 1-8 illustrate a folding knife 10, according to one embodiment. As best shown in FIGS. 1 and 2, the knife 10 comprises a handle portion, or handle, 12 and a tool element such as a blade 14 pivotally coupled to the handle for pivoting between a folded, closed position in which the blade is at least partially received in the handle (FIG. 3) and an open or use position extending substantially parallel to the handle (FIG. 1).

Although the present disclosure describes a folding knife, the embodiments described herein more generally can be folding tools comprising a handle and one or more tool elements that can pivot between a closed position and an open position relative to the handle. For example, in one embodiment a folding tool can comprise a handle and a screwdriver that is pivotally coupled to the handle for pivoting between open and closed positions.

As best shown in FIG. 2, the handle 12 in one example comprises first and second handle portions in the form of first and second side panels 16 and 18, respectively, and a spacer 20 disposed between and separating the side panels 16, 18. The blade 14 can be pivotally coupled to the second side panel 18 by a pivot 24 extending through an opening 26 in a tang portion 28 of the blade 14, a washer 108 and a corresponding opening 30 in the second side panel 18. The tang portion 28 can be formed with an annular recess surrounding opening 26 and dimensioned to receive an enlarged head portion 34 of the pivot 24 so that the upper surface of the head portion 34 is substantially flush with the side of the tang portion 28. A screw 36 can be tightened into a threaded opening (not shown) in the pivot 24 to secure the blade 14 to the side panel 18. Other alternative pivots and fasteners can be used.

The spacer 20 can be secured to the inner surface of the side panel 18. For example, screws 38 can extend through respective openings 40 in the spacer 20 and tightened into respective threaded openings 42 in the side panel 18. The screws 38 are desirably countersunk in the spacer so that the first side panel 16 can lie flush against the spacer 20. The spacer 20 can be in-line with the blade 14 and can have a forward end portion that contacts an end surface of the tang portion 28 to prevent pivoting of the blade past the open position.

The handle 12 has a top side 110 and a bottom side 112 extending the length of the handle. A blade receiving channel 114 can be defined between the first and second side panels 16, 18 and desirably receives at least the sharpened edge of the blade when the blade is in the closed position. The first and second side panels 16, 18 in the illustrated embodiment are dimensioned to enclose substantially the entire blade when it is in the closed position. In other embodiments, however, the side panels 16, 18 can be dimensioned to cover less than the entire blade when the blade is in the closed position.

A conventional spring clip 44 optionally can be secured or coupled to the outer surface of the side panel 18. For example, this can be accomplished by fasteners such as one or more screws 46 tightened into respective threaded openings 48 in the side panel 18. The clip 44 can be used to mount the knife on the user's clothing such as on a belt or pocket, as commonly known in the art.

Figure 4:
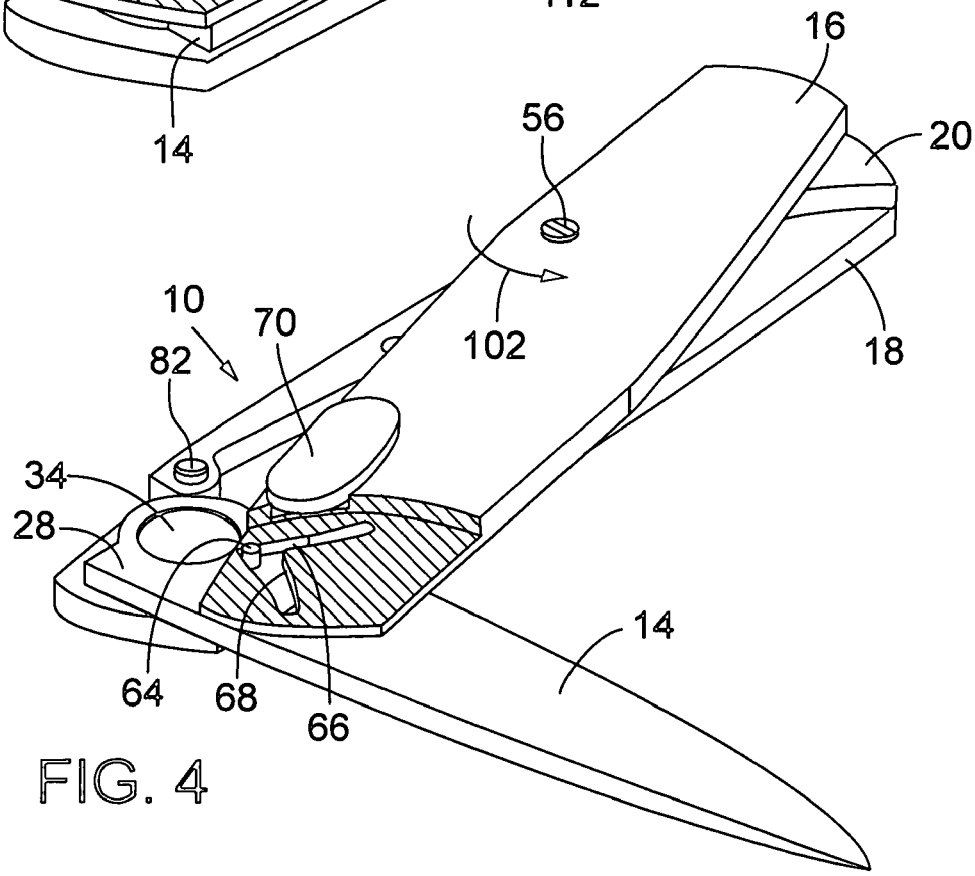
Figure 5:
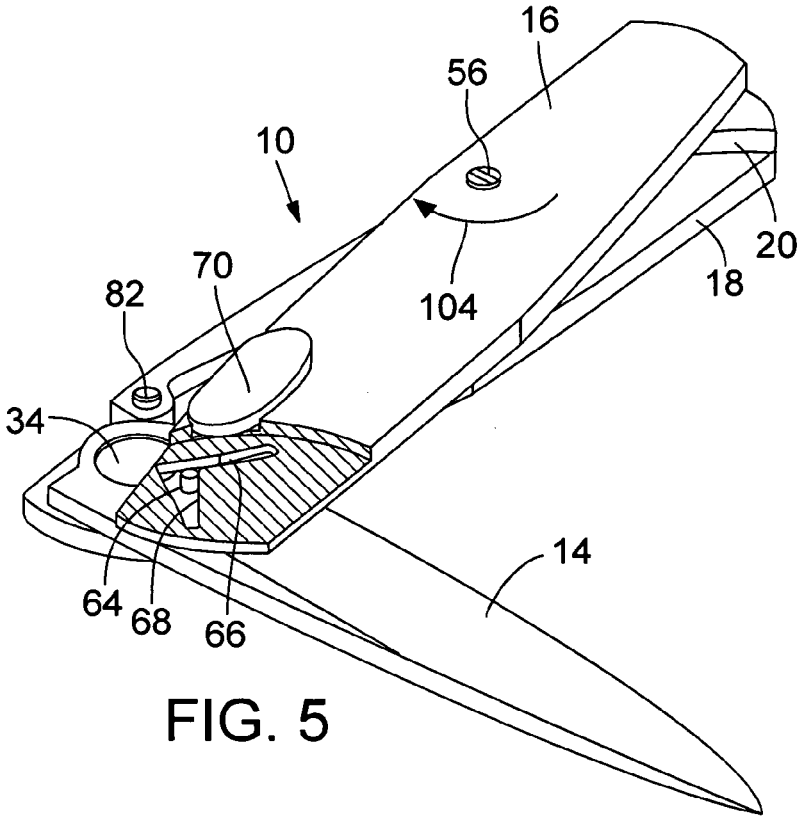

The first side panel 16 can be pivotally coupled to the second side panel 18 and to the tang portion 28 of the blade 14 such that pivoting of the first side panel 16 causes pivoting movement of the blade 14. In this manner, the first side panel 16 functions as an opening mechanism (and in one form desirably also as a closing mechanism) for assisting a user in opening the blade 14. More specifically, and as shown in FIG. 2, the first side panel 16 can be pivotally connected to the spacer 20 by a pivot such as by a pivot pin 50, thereby allowing the first side panel 16 to pivot relative to the second side panel 18 about the pin 50. The first side panel 16 can be pivoted between a first, non-pivoted position aligned with the second side panel 18 (FIGS. 1, 3 and 6) and second, pivoted position whereby the first side panel 16 is skewed with respect to the second side panel 18 (FIGS. 4 and 5). The pin 50 in the illustrated configuration is press-fitted into an opening 22 in the second side panel 18 and extends laterally therefrom through an opening 52 in the spacer 20 and a corresponding opening 54 in the first side panel 16. A fastener, such as a screw 56 extending into a threaded opening 58 in the pin 50, retains the first side panel 16 on the pin 50.

FIGS. 3-6 show a portion of the first side panel 16 adjacent the tang portion 28 broken away to show a projection receiving guide such as a channel or groove 62 (also referred to herein as a slot) formed on the inner surface of the first side panel 16. The channel can be of varying shapes, but desirably comprises portions that intersect or are joined together adjacent to side 110 and diverge moving in a direction away from side 110 and toward side 112. The tang portion 28 comprises a guide engaging projection such as a pin 64 that is affixed to or coupled to one side thereof and extends transversely into the channel 62. The pin 64 can be in sliding contact with the inner surface of the channel 62 such that pivoting movement of the side panel 16 relative to the pin 64 is effective to move the pin along the inner surface of the channel, thereby pivoting the blade 14 about its pivot axis. As shown in FIG. 2, an optional sleeve bearing 106 can be mounted over the pin 64 for contact with the inner surface of the channel 62. The sleeve bearing 106 can rotate relative to the pin 64 to reduce sliding friction with the inner surface of the channel 62.

The channel 62 in the form shown comprises a first channel portion, or leg, 66 in communication with and angled with respect to a second channel portion, or leg, 68. In the illustrated embodiment, the channel 62 can be generally V-shaped and oriented such that the intersection of the first and second channel portions is adjacent the top side 110 of the handle and the channel portions 66, 68 diverge or flare away from each other in a direction toward the bottom side 112 of the handle.

Figure 3:
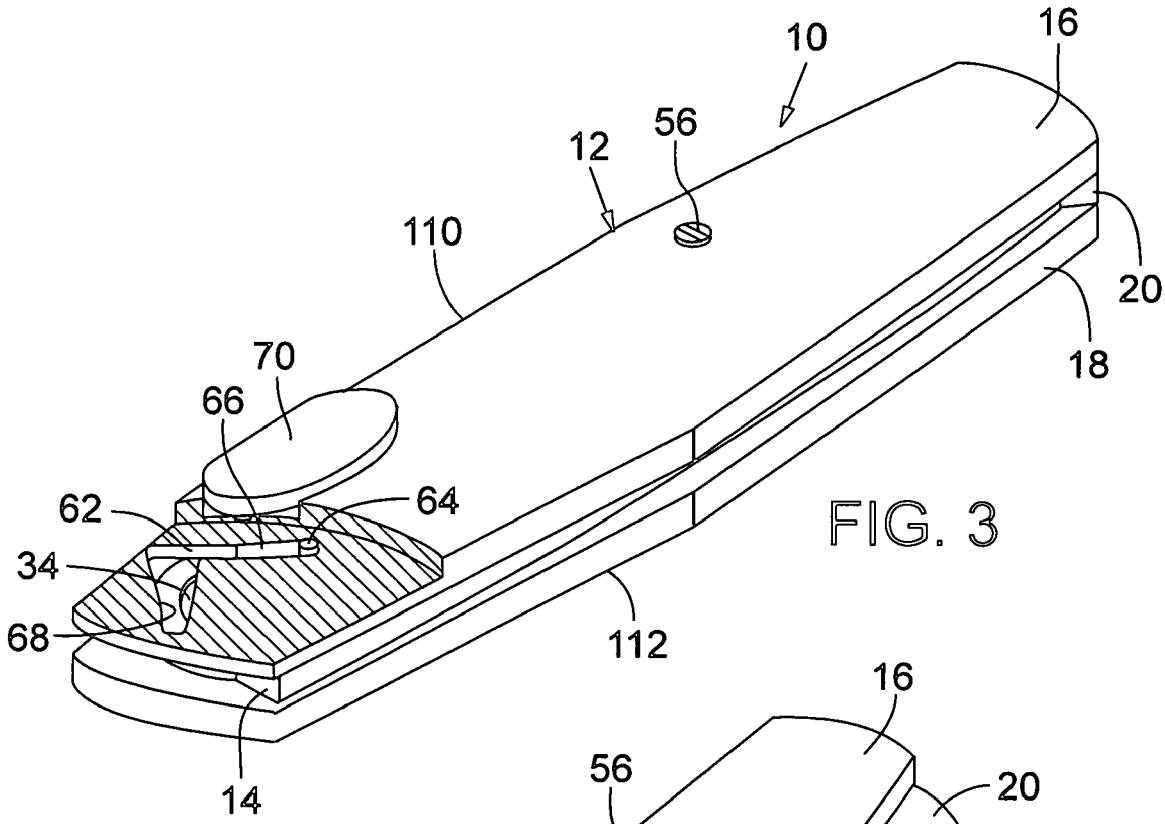
FIGS. 3-6 are perspective views of the folding knife of FIG. 1 shown with a portion of the handle broken away and a movable side panel of the handle and the blade in various positions as the blade is pivoted from the closed, folded position to the open position.

As can be seen in the FIG. 3 embodiment, when the blade 14 is in the closed position and the first side panel 16 is in the non-pivoted position, the pin 64 resides at the rear end of the first channel portion 66. Referring to FIG. 4, as the first side panel 16 of this example is pivoted relative to the second side panel 18 in the direction of arrow 102, the pin 64 is caused to move within the first channel portion 66 to a corner of the channel 62 formed by the intersection of the channel portions 66, 68. Movement of the pin 64 causes corresponding movement of the blade 14 from the closed position to an intermediate position between the closed and open positions (as depicted in FIGS. 4 and 5). Referring to FIG. 5, further pivoting of the first side panel 16 in the reverse direction (in the direction indicated by arrow 104) allows the pin 64 to engage and move along the inner surface of the second channel portion 68, which causes the blade 14 to pivot from the intermediate position (FIGS. 4 and 5) to the open position (FIG. 6).

Figure 6:
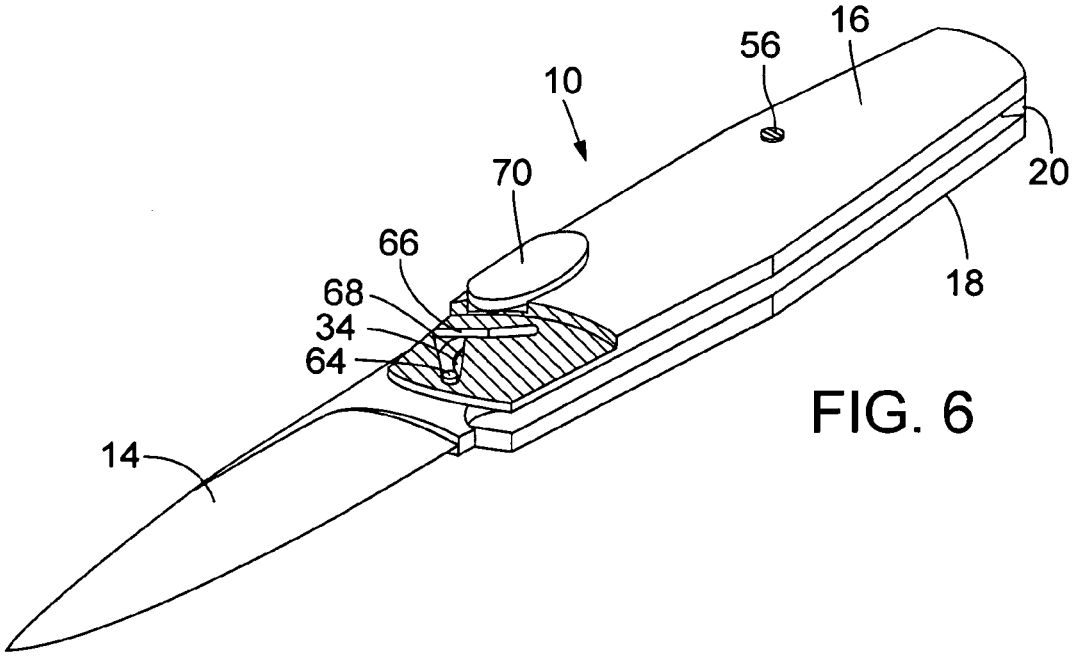

Closing or folding the blade 14 from the open position shown in FIG. 6 is accomplished in a similar manner. With the blade 14 in the open position, pivoting the first side panel 16 to the pivoted position causes the pin 64 to move within the second channel portion 68 to the corner of the channel 62, which causes the blade to pivot from the open position to the intermediate position (FIGS. 4 and 5). Pivoting the first side panel 16 back to the non-pivoted position in the reverse direction moves the pin within the first channel portion 66, causing the blade to pivot from the intermediate position to the closed position (FIG. 3).

In an alternative embodiment, the knife can have a channel formed in the tang portion 28 and a projection or pin affixed to the inner surface of the first side panel 16. Pivoting the side panel 16 moves the pin within the channel to produce movement of the blade.

In other embodiments, the pivotable portion of the handle need not be a unitary side panel as shown in the illustrated embodiment. For example, the first side panel can comprise a pivotable forward end portion and a stationary rear end portion. The forward end portion can be pivotally coupled to the handle 12 and formed with a channel for receiving the pin 64, and thus functions as the mechanism for pivoting the blade. In another embodiment, the mechanism for pivoting the blade can be a movable or slidable button or lever incorporated in the side panel of the handle.

Figure 7:
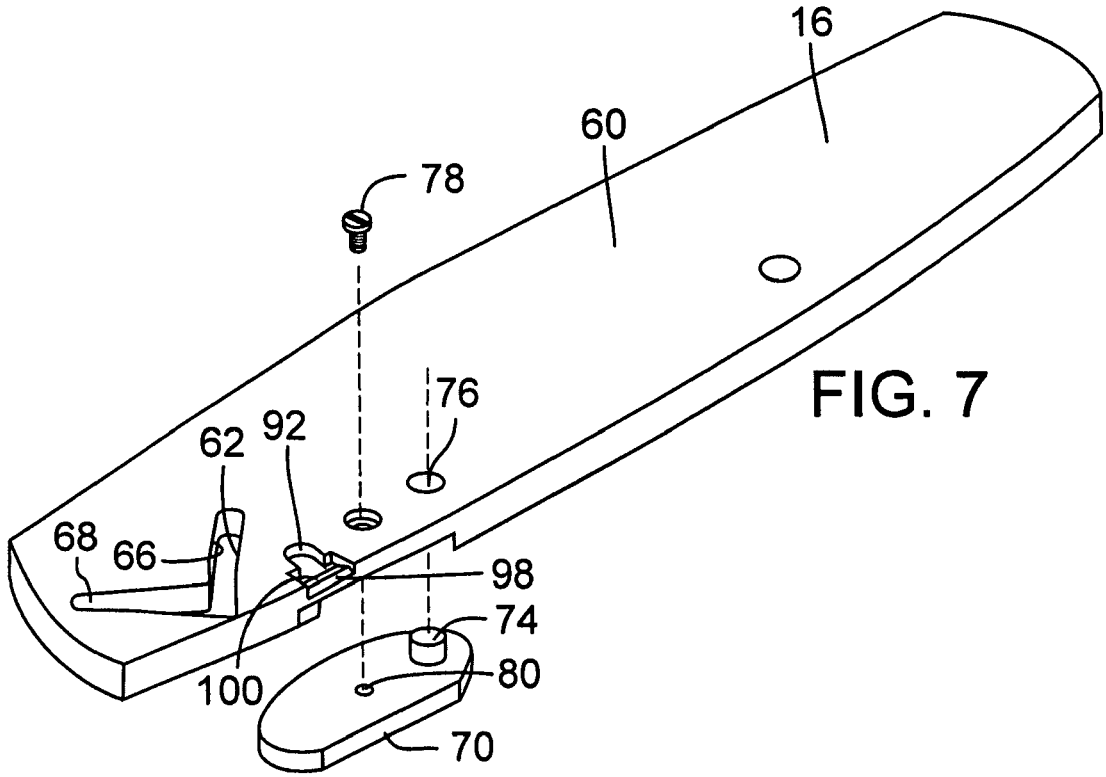
FIG. 7 is a perspective view of the stationary side panel of the knife of FIG. 1.

A projection, or button, 70 can be provided on the outer surface of the first side panel 16 to assist a user in manually pivoting the side panel 16 with a thumb while grasping the handle 12. As best shown in FIG. 2, the projection 70 in the illustrated configuration is disposed in a recess 72 formed in the outer surface of the side panel 16. As shown in FIG. 7, the lower, or non-exposed, surface of the projection 70 can include a post 74 extending into a corresponding opening 76 in the side panel 16. A screw 78 can extend through a corresponding opening in the side panel 16 and can be tightened into a threaded opening 80 in the projection 70 to secure the projection to the side panel.

Figure 8:
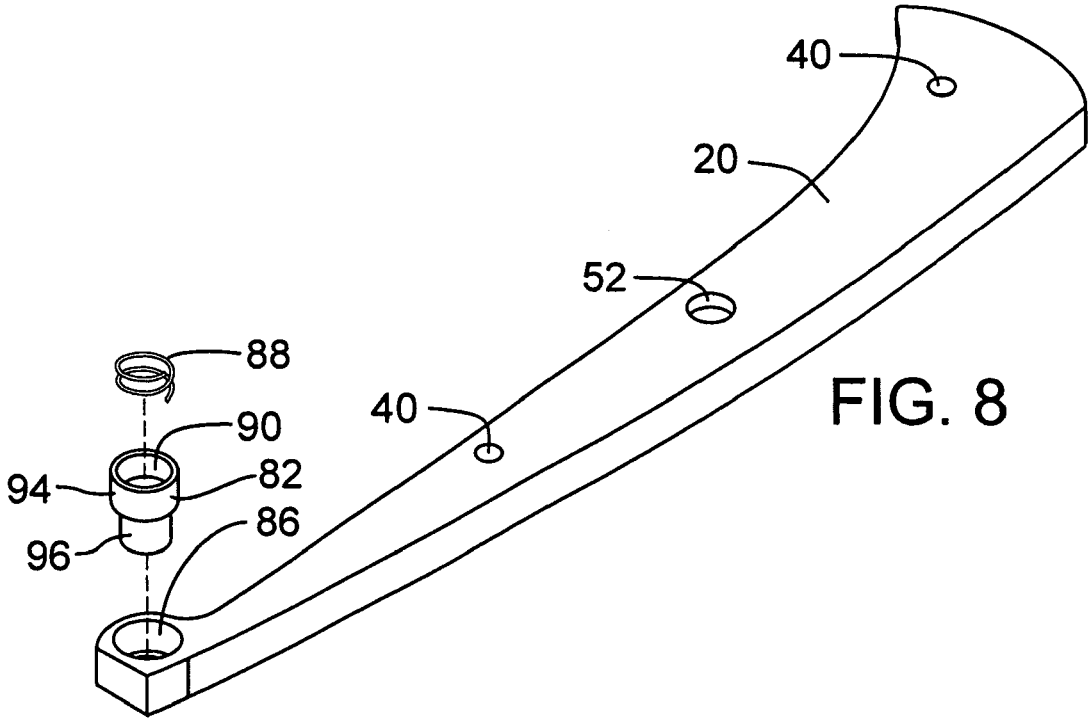
FIG. 8 is a perspective view of the spacer of the knife of FIG. 1.

A retaining mechanism for side panel 16 can be provided, for example in the form of a projection 82 that is operable to exert a retaining force against the side panel. The force exerted by the projection against the side panel 16 is desirably sufficient to prevent pivoting of the side panel 16 under its own weight, but yet allows a user to pivot the side panel 16 for opening or closing the blade. More specifically, in the illustrated configuration, the projection 82 has a base 94 disposed in an opening 84 (FIG. 2) in the side panel 18 and an outer end portion 96 that extends laterally outwardly from the opening 84 and through another opening 86 in the forward end portion of the spacer 20. A biasing mechanism, such as the illustrated compression spring 88, can be disposed in the opening 84 and can extend partially into an opening 90 in the base 94 (FIG. 8). The spring 88 in this example exerts a biasing force on the projection 82, urging the projection 82 laterally toward the side panel 16. When the first side panel 16 is in the non-pivoted position (wherein the first side panel 16 is aligned with the second side panel 18), either with the blade 14 in the closed position (as shown in FIG. 3) or with the blade in the open position (FIGS. 1 and 6), the projection 82 bears against the inside surface of the first side panel 16 to assist in retaining the first side panel 16 in the non-pivoted position.

As shown in FIG. 7, the inner surface of the first side panel 16 can be formed with an opening 92 dimensioned to receive the outer end portion 96 of the projection 82 when the first side panel 16 is in the non-pivoted position. The edge portion of the first side panel 16 adjacent the opening 92 can be formed with first and second inclined surfaces 98 and 100, respectively, in the path of the projection 82. The inclined surfaces 98, 100 function as cam surfaces which cause the projection 82 to retract slightly into opening 86 as the side panel 16 is pivoted over the projection 82. Thus, in this example, when the first side panel 16 is pivoted to the non-pivoted position, the projection 82 retracts as it engages the first inclined surface 98 and then extends into the opening 92 when the opening 92 is aligned over the projection 82. Conversely, when the first side panel 16 is pivoted away from the non-pivoted position, the projection 82 retracts in this example as the second inclined surface 100 comes in contact with the top of the projection 82 so as to remove the projection 82 from engagement with the opening 92.

Opening and closing of the blade 14 in this embodiment can be accomplished in the following manner. To open the blade, the user grasps the handle 12 in the usual manner and presses on the projection 70 with the thumb in a direction away from the upper side 110 of the handle 12 (in the direction of arrow 102 in FIG. 4) to pivot the first side panel 16 to the pivoted position, which in turn causes the blade to pivot from the closed position to the intermediate position. The user then reverses the direction of the pressure applied the projection 70 so as to pivot the first side panel 16 back to the non-pivoted position, which in turn desirably causes the blade to pivot from the intermediate position to the open position. Closing the blade 14 can be accomplished by simply pivoting the first side panel 16 to the pivoted position and then back to the non-pivoted position by applying pressure to the projection 70 in the appropriate direction using the thumb. As can be appreciated, opening and closing of the blade can be accomplished by simply applying pressure directly to the handle using one's thumb rather than to a portion of the blade. Alternatively, the opening mechanism can be used to partially open the blade, such as to the intermediate position with the full opening of the blade being otherwise accomplished, such as by manually applying pressure on the blade.

FIGS. 9-19 show another embodiment of a folding knife, indicated generally at 200. The knife 200 is similar in construction to the knife 10 described above. One difference between the knife 200 and the knife 10 is that the former includes a blade locking mechanism, such as in the form of a liner lock 202.

Figure 9:
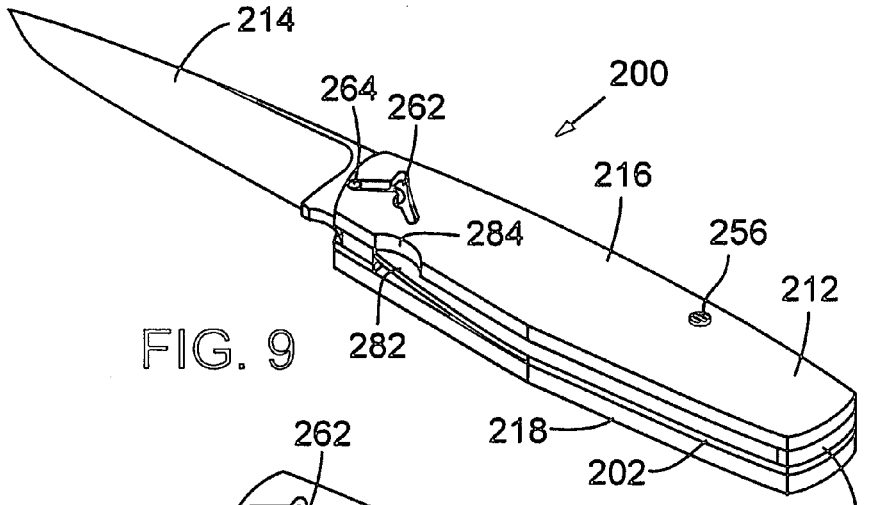
FIG. 9 is a perspective view of a folding knife shown with the blade in the open position, according to another embodiment.

The illustrated knife 200 comprises a handle portion, or handle, 212 and a blade 214 pivotally coupled to the handle for pivoting between a folded, closed position in which the blade is at least partially received in the handle (FIG. 11) and an open or use position (FIG. 9).

Figure 10:
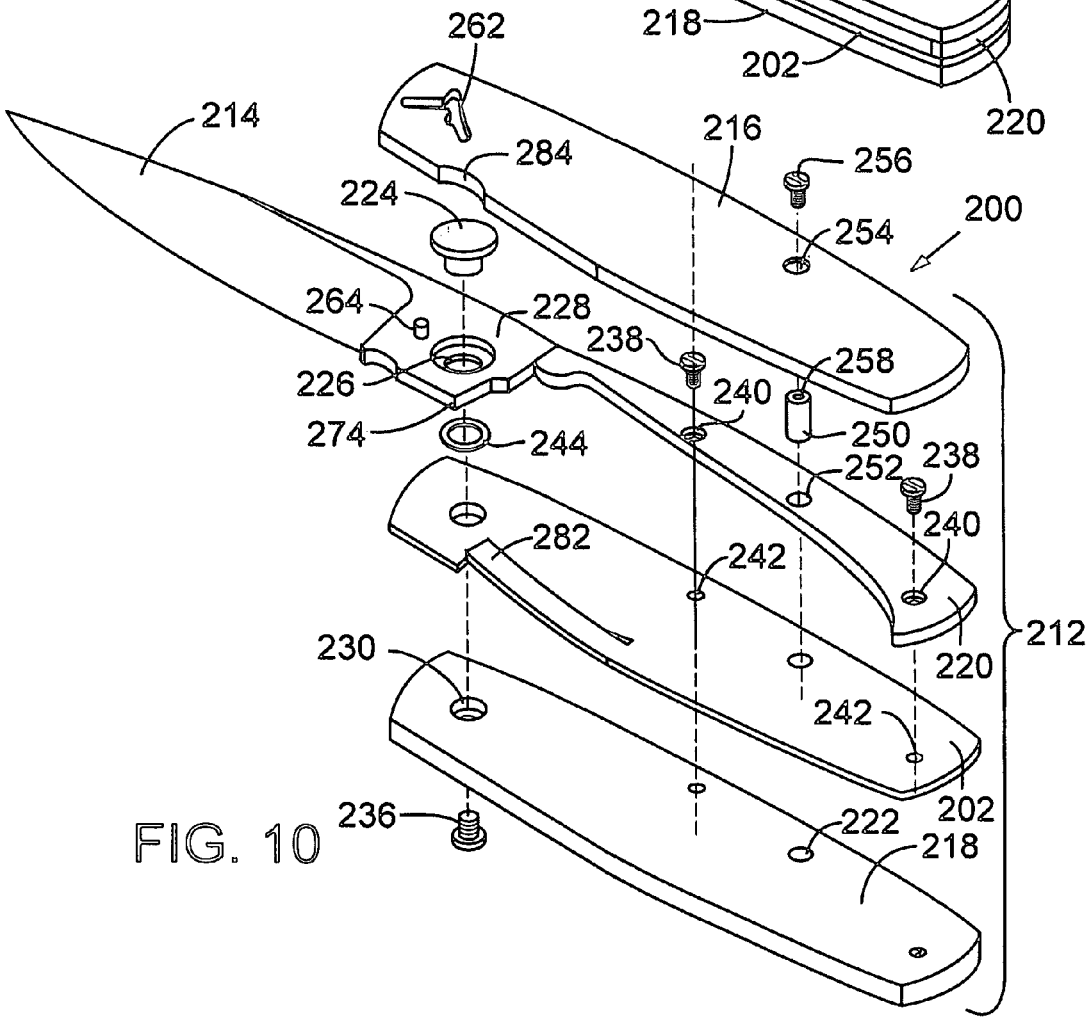
FIG. 10 is an exploded, perspective view of the knife of FIG. 9.
Figure 11:
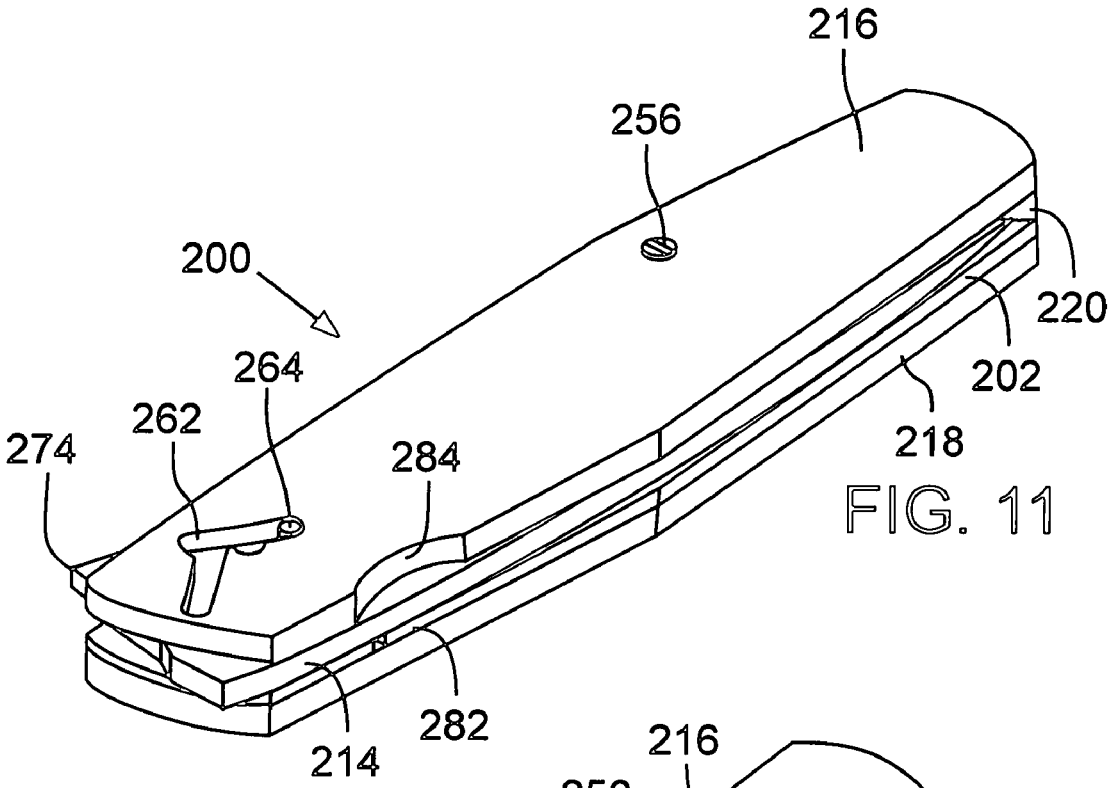
FIGS. 11-13 are perspective views of the folding knife of FIG. 9 showing a movable side panel of the handle and the blade in various positions as the blade is pivoted away from the closed position.

As best shown in FIG. 10, the handle 212 comprises first and second side panels 216 and 218, respectively, and a spacer 220 disposed between and separating the side panels. The exemplary liner lock 202 is positioned between the second side panel 218 and the spacer 220. The blade 214 is pivotally coupled or connected to the second side panel 218 such as by a pivot 224 extending through an opening 226 in a tang portion 228 of the blade 214, a washer 244, a corresponding opening in the liner lock 202, and a corresponding opening 230 in the second side panel 218. A screw 236 can be tightened into a threaded opening (not shown) in the pivot 224 to secure the blade 214 to the side panel 218. The spacer 220 is desirably secured to the inner surface of the side panel 218, such as by screws 238 extending through respective openings 240 in the spacer 220 and the liner lock 202 and tightened into respective threaded openings 242 in the side panel 218.

Figure 12:
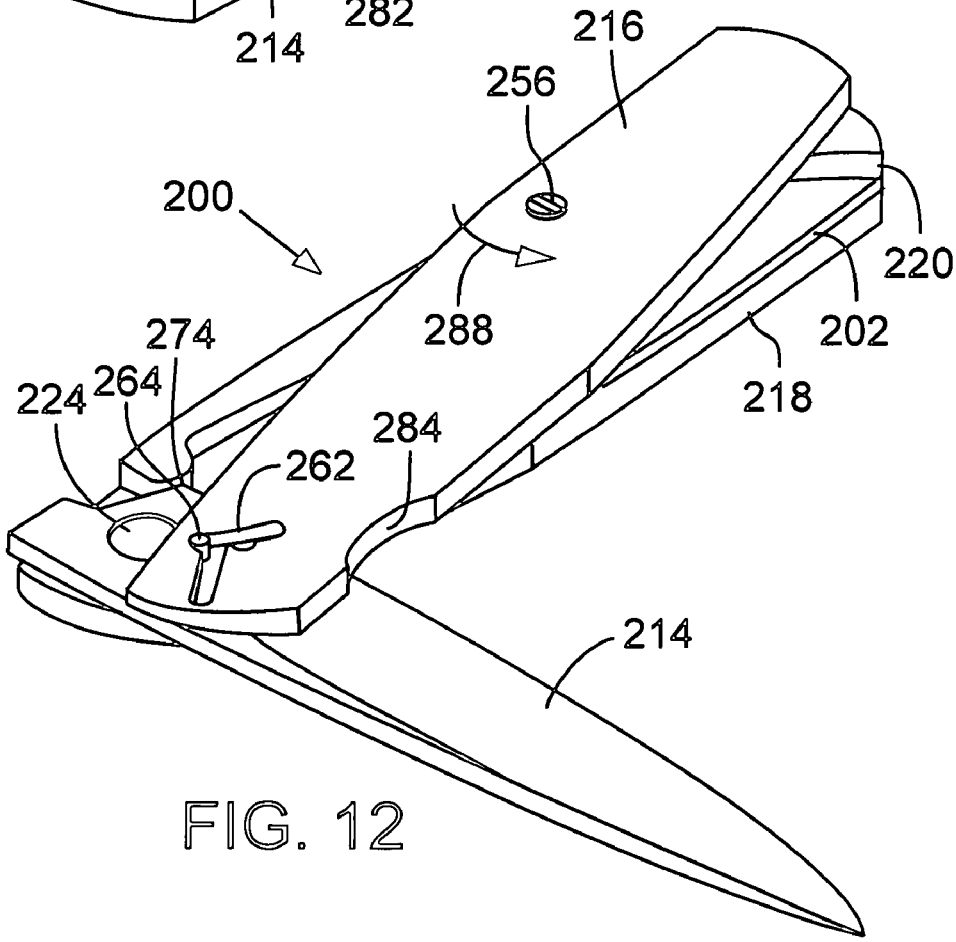
Figure 13:
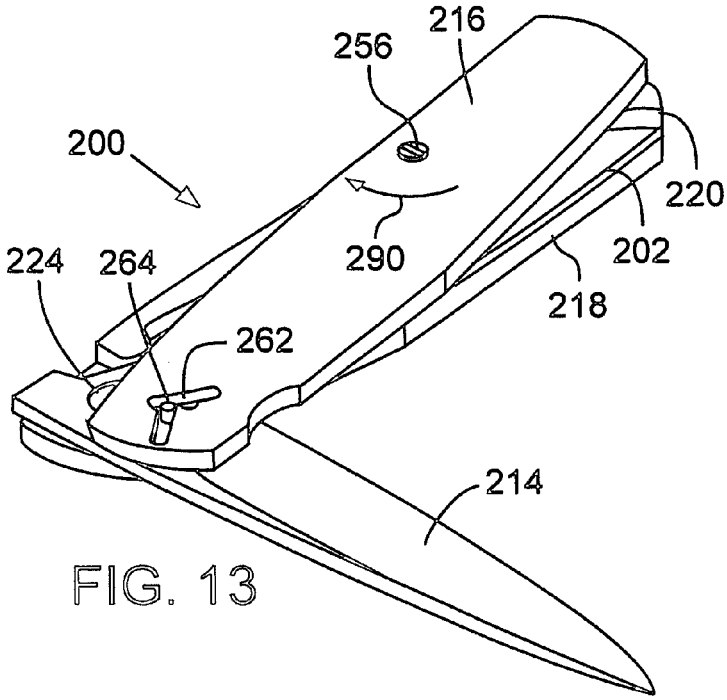

The first side panel 216 is pivotally coupled to the spacer 220, such as by a pivot pin 250, thereby allowing the first side panel 216 to pivot relative to the second side panel 218 about the pin 250. The first side panel 216 can be pivoted between a first, non-pivoted position aligned with the second side panel 18 (FIGS. 9 and 11) and second, pivoted position whereby the first side panel 216 is skewed with respect to the second side panel 218 (FIG. 12). The pin 250 in the illustrated embodiment is press-fitted into an opening 222 in the second side panel 218 and extends laterally therefrom through an opening 252 in the spacer 220 and a corresponding opening 254 in the first side panel 216. A screw 256 can extend into threaded opening 258 in the pin 250 to retain the first side panel 216 on the pin.

The forward end portion of the side panel 216 is formed with a projection egaging guide such as a channel or groove 262. The channel 262 receives a projection, such as a pin 264 affixed to or coupled to and extending transversely from the tang portion 228 of the blade. Movement of the channel 262 relative to the pin 264 is effective to produce pivoting movement of the blade 214 upon pivoting movement of the side panel 216, as previously described.

Figure 14:
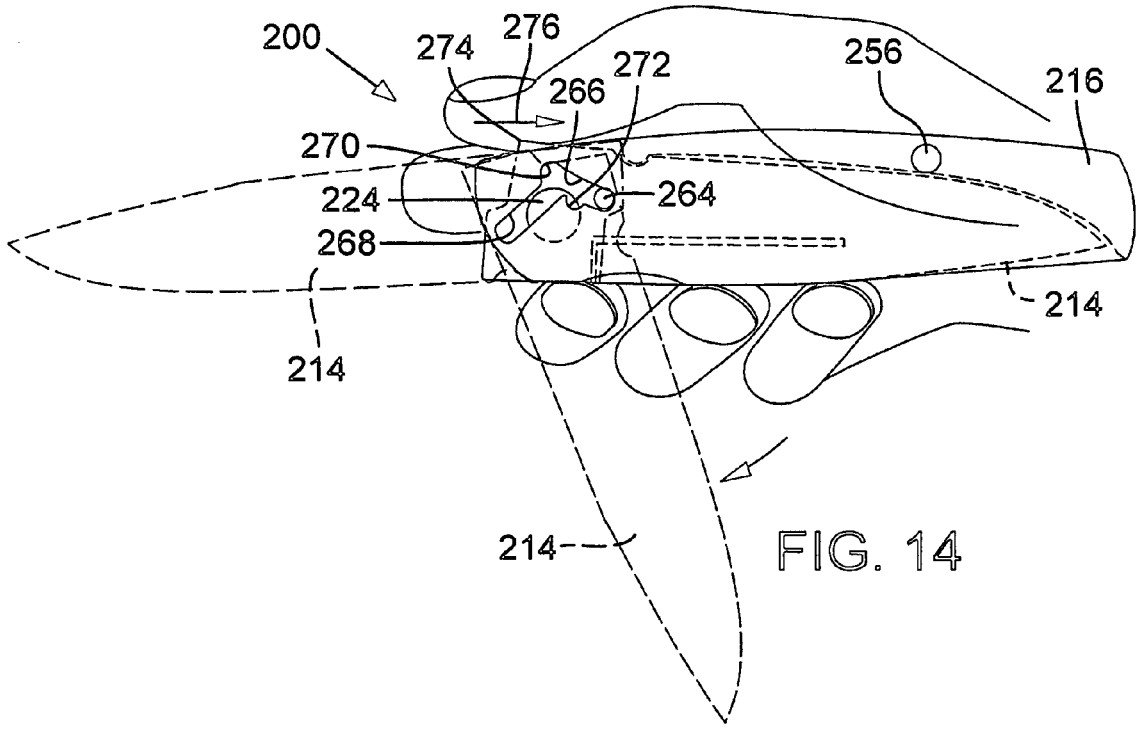
FIG. 14 is a side elevation view of the folding knife of FIG. 9 showing a user's hand opening the blade.

As best shown in FIG. 14, the channel 262 in the illustrated configuration includes a first channel portion, or leg, 266 in communication with a second channel portion, or leg, 268. The first channel portion 266 desirably intersects the second channel portion 268 and extends slightly past the second channel portion so as to desirably form an arcuate notch 270 that is about the size of the diameter of the pin 264. The channel portions diverge away from each other moving away from the intersection of the channel portions. In the form shown, the channel is generally V-shaped. The first channel portion 266 can also desirably be formed with another arcuate notch 272 sized to receive the pin 264. The significance of notches 270, 272 is explained below in connection with the description of the use of the knife.

Figure 15:
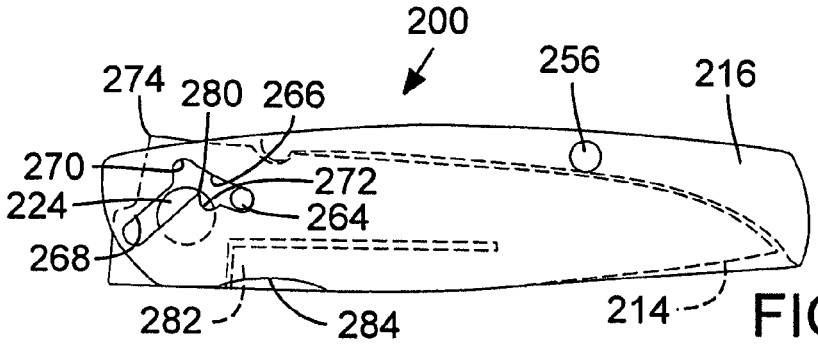
FIGS. 15-19 are side elevation views of the folding knife of FIG. 9 showing the movable side panel and the blade in various positions between the closed position and the open position.
Figure 16:
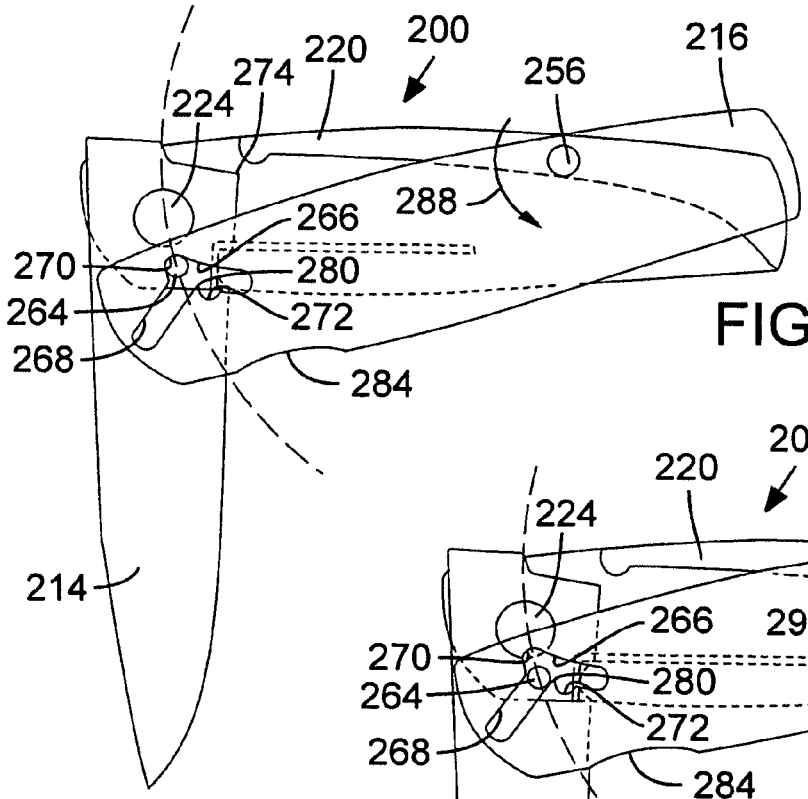
Figure 17:
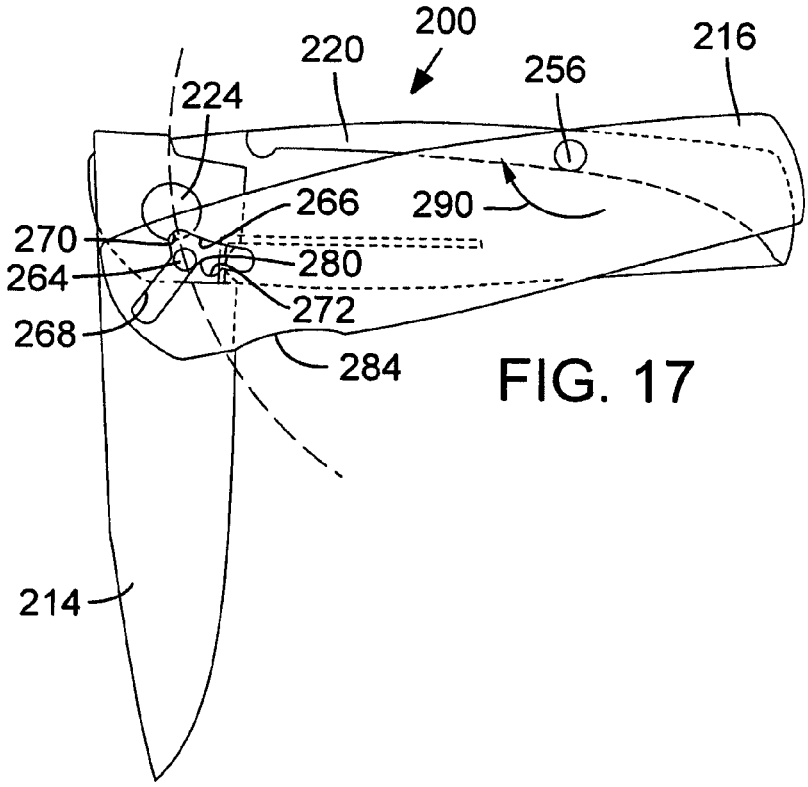
Figure 18:
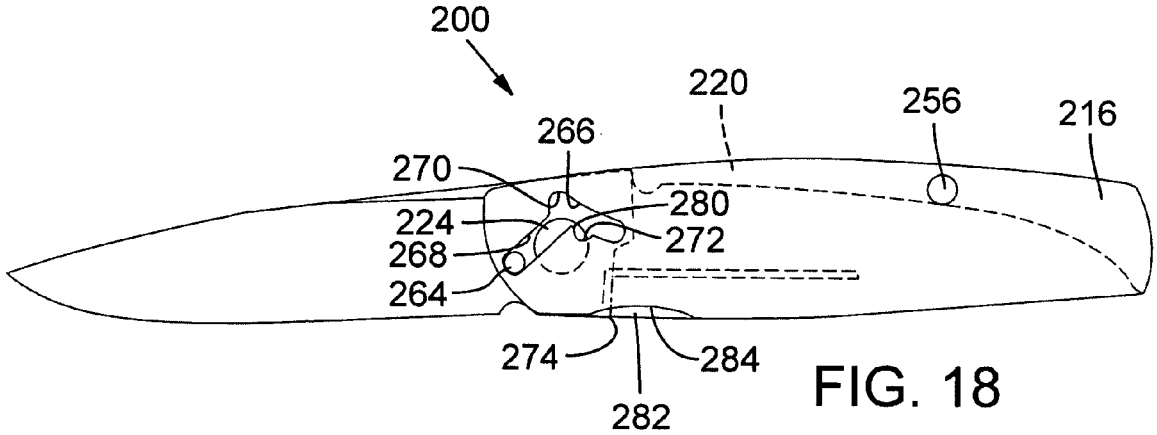
Figure 19:
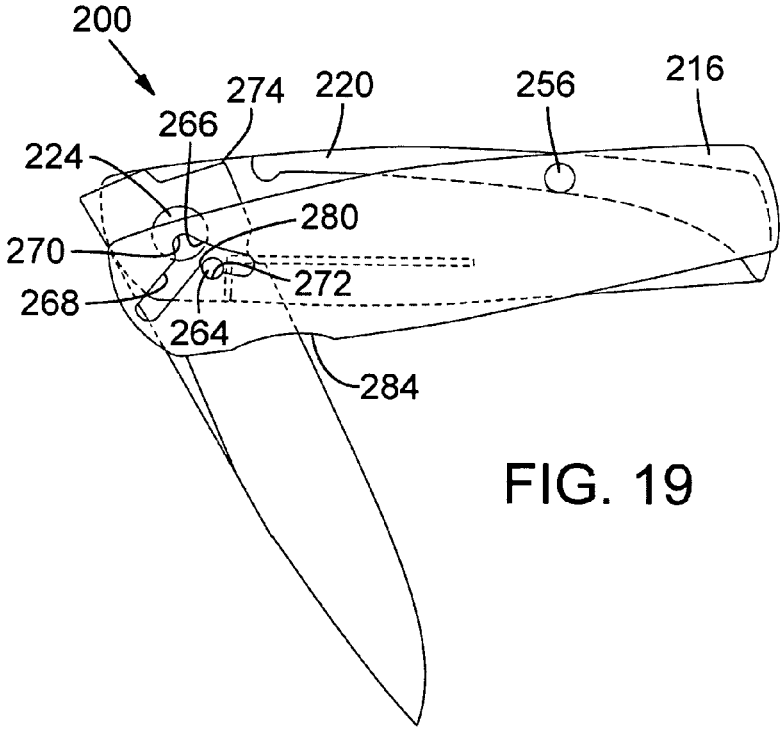

As can be seen in FIG. 15, in this embodiment, when the blade 214 is in the closed position and the first side panel 216 is in the non-pivoted position, the pin 264 resides at the rear end of the first channel portion 266. Referring to FIG. 16, as the first side panel 216 is pivoted relative to the second side panel 218 in the direction of arrow 288, the pin 264 is caused to move within the first channel portion 266 and into the notch 270 at the end of the first channel portion. Movement of the pin causes corresponding movement of the blade 214 from the closed position to an intermediate position between the closed and open positions. The notch 270 positions the pin 264 forwardly of an edge 280 at the intersection of the first and second channel portions. As a result, pivoting the first side panel 216 in the opposite direction (in the direction indicated by arrow 290) causes the pin 264 to engage a surface of the second channel portion 268 forwardly of edge 280, as illustrated in FIG. 17. Further pivoting of the first side panel 216 back to the non-pivoted position moves the pin 264 within the second channel portion 268, which causes the blade 214 to pivot from the intermediate position to the open position (FIG. 18).

The liner lock 202 can include a resilient locking element 282 (also referred to as a locking bar) that is normally biased in a direction laterally toward the first side panel 216. When the blade 214 is in the closed position (FIG. 11), the illustrated locking element 282 bears against the side of the tang portion 228 of the blade and therefore prevents the blade from opening under its own weight. When the blade is pivoted to the open position, the locking element 282 snaps into a locked position behind and in contact with an end surface of the tang portion 228 (as best shown in FIG. 18), thus protecting against inadvertent closure of the blade. To unlock the blade, the locking element 282 is moved laterally away from the tang portion 228 toward the second side panel 218 until the locking element 282 clears the edge of the tang portion 228, at which point the blade can be pivoted toward the closed position. The first side panel 216 can be formed with a notch 284 adjacent the free end of the locking element 282 to allow a user to more easily press against the side of the locking element with a thumb or finger to unlock the blade.

As previously described in connection with the embodiment of FIGS. 1-8, the blade 214 can be opened by first moving the first side panel 216 to the pivoted position and then back to the non-pivoted position. If, while opening the blade, the first side panel 216 is moved toward the pivoted position and then back toward the non-pivoted position before the pin 264 fully engages notch 270, the pin 264 may engage the first channel portion 266 rather than the second channel portion 268. If this occurs, the pin 264 can engage notch 272 to prevent pivoting of the blade back to the closed position, thereby protecting against inadvertent closure of the blade. From this position, the blade can be fully opened manually or by moving the side panel 216 to the pivoted position to engage the pin 264 in the notch 270 and then back to the non-pivoted position to open the blade.

As an alternative way to open the blade, the tang portion 228 of the blade 214 can have an extension portion 274 that extends through the top end of the handle 212 when the blade 214 is pivoted to the closed position. As illustrated in FIG. 14, when the blade 214 is in the closed position, the extension portion 274 is exposed out of the top of the handle and therefore can be used to pivot the blade toward the open position by applying pressure to the extension portion generally in a rearward direction (toward the rear of the handle) as indicated by arrow 276. For example, while holding the knife in a hand, the user can "flick" the extension portion 274 rearward with the pointer finger to pivot the blade outward from the handle 212. Sufficient pressure can be applied to the extension portion 274 to pivot the blade to the intermediate position shown in FIG. 16. As can be appreciated, movement of the blade to the intermediate position causes movement of the first side panel to the pivoted position. The blade 214 can then be further pivoted to the open position by moving the first side panel 216 back to the non-pivoted position.

In view of the many possible embodiments to which the principles of the disclosed invention may be applied, it should be recognized that the illustrated embodiments are only desired examples of the invention and should not be taken as limiting the scope of the invention. For example, although less desirable, a handle activated mechanism can be used to partially open the blade, with further opening being performed by applying pressure directly to the blade. Also, a different mechanism or approach can be used to close the blade than is used to open the blade. Rather than being limited by the examples, the scope of the invention is defined by the following claims. I therefore claim as my invention all that comes within the scope and spirit of these claims.

I claim:

1. A folding knife comprising:

a blade having a tang portion; and a handle comprising a first handle portion and a second handle portion, each handle portion being substantially elongated such that the blade will be substantially covered by the handle portions when in a closed position, and each handle portion is adapted for contact by a user during operation of the knife, the first handle portion being pivotally coupled to the second handle portion at a handle pivot for pivoting movement of the first handle portion relative to the second handle portion, the blade tang portion being pivotally coupled to the second handle portion at a blade pivot spaced from the handle pivot for pivoting movement of the blade between an open position and the said closed position, the first handle portion being coupled to the blade such that pivoting movement of the first handle portion in a first rotational direction causes movement of the blade from the closed position to a partially open position and further pivoting movement of the first handle portion in a second rotational direction, opposite the first rotational direction, causes movement of the blade from the partially open position to the open position.

2. The folding knife of claim 1, wherein the first and second handle portions comprise first and second side panels, respectively, of the handle that are grippable by a user, the side panels being laterally spaced from each other to define a blade recess for receiving at least a portion of a sharpened edge of the blade when the blade is in the closed position.

3. The folding knife of claim 1, wherein one of the tang portion and the first handle portion comprises a guide and the other of the tang portion and the first handle portion comprises a transversely extending projection coupled thereto and partially engaged by the guide, the projection being slidable relative to the guide and being guided by the guide such that pivoting the first handle portion causes the blade to pivot.

4. The folding knife of claim 3, wherein the guide comprises a channel comprising diverging first and second channel portions and the projection comprises a pin at least partially received in the channel.

5. The folding knife of claim 4, wherein the channel comprises a generally V-shaped channel, wherein the second channel portion extends at an angle with respect to the first channel portion, and wherein when the first handle portion is pivoted in the first direction, the pin is slidable within the first channel portion to cause pivoting of the blade from the closed position to the partially open position, and when the first handle portion is pivoted in the second direction, the pin is slidable within the second channel portion to cause pivoting of the blade from the partially open position to the open position.

6. The folding knife of claim 4, wherein the channel is formed in the first handle portion and the pin is secured to the tang portion.

7. The folding knife of claim 4, further comprising a rotatable sleeve mounted over the pin and extending into the channel to facilitate movement of the pin within the channel.

8. The folding knife of claim 1, wherein the first handle portion includes a laterally extending projection adjacent the tang portion to allow a user to pivot the first handle portion by applying pressure to the projection.

9. The folding knife of claim 1, further comprising a projection disposed between the first and second handle portion and biasing mechanism configured to resiliently urge the projection laterally against an inner surface of the first handle portion, the projection exerting a retaining force against the first handle portion to assist in retaining the first handle portion against pivoting movement relative to the second handle portion under its own weight.

10. The folding knife of claim 9, further comprising a spacer disposed between the first and second handle portion and having an opening, the projection disposed in and extending outwardly from the opening in the spacer, the spacer being formed with a forward end portion in line with the blade and positioned to contact the tang portion when the blade is pivoted to the open position and prevent pivoting of the blade past the open position.

11. The folding knife of claim 4, wherein the handle comprises a top side and a bottom side, and wherein the channel is formed in the first handle portion, wherein the first channel portion and the second channel portion intersect at a location adjacent the top side of the handle and diverge from one another moving toward the bottom side of the handle.

12. The folding knife of claim 11, wherein the first channel portion extends past the intersection of the first channel portion and the second channel portion.

13. A folding knife comprising:

a blade having a tang portion; and a handle comprising a first handle portion and a second handle portion, the first handle portion being pivotally coupled to the second handle portion at a handle pivot for pivoting movement of the first handle portion relative to the second handle portion, the blade tang portion being pivotally coupled to the second handle portion at a blade pivot spaced from the handle pivot for pivoting movement of the blade between an open position and a closed position, the first handle portion being slidably coupled to the tang portion such that pivoting movement of the first handle portion relative to the second handle portion causes pivoting movement of the blade wherein the first handle portion is formed with an elongated channel and the tang portion has a pin extending transversely into the channel such that pivoting the first handle portion from a first position to a second position moves the pin within the channel to cause pivoting movement of the blade from the closed position to an intermediate position between the closed and open positions, and pivoting the first handle portion from the second position back to the first position further moves the pin within the channel to cause pivoting of the blade from the intermediate position to the open position.

14. The folding knife of claim 13, wherein the channel comprises a generally V-shaped channel.

15. The folding knife of claim 14, wherein the handle has a top side and a bottom side and the first handle portion has a forward end portion adjacent the tang portion, wherein pivoting the forward end portion in a direction toward the bottom end of the handle pivots the first handle portion from the first position to the second position and pivoting the forward end portion in a direction toward the top end of the handle pivots the first handle portion from the second position back to the first position.

16. The folding knife of claim 13, wherein the first handle portion comprises an outer side panel of the handle.

17. A folding knife comprising:

a handle;

a blade having a tang portion that is pivotally coupled to the handle at a blade pivot for pivoting movement of the blade between an open position and a closed position;

the handle comprising a first handle portion pivotally connected to the tang portion and a second handle portion that is pivotal relative to the first handle portion about a handle pivot spaced from the blade pivot, the second handle portion being in sliding contact with the tang portion; and means for converting pivoting movement of the second handle portion relative to the first handle portion into pivoting movement of the blade, such that pivoting the second handle portion relative to the first handle portion in a first direction causes the blade to move to a partially open position, and subsequently pivoting the second handle portion in a rotational direction opposite the first direction moves the blade from the partially open position to the open position;

said handle defines a blade receiving channel between the first and second handle portions, the first and second handle portions extending the length of the blade.

18. The folding knife of claim 17, wherein the means for converting pivoting movement of the second handle portion relative to the first handle portion into pivoting movement of the blade comprises an elongated channel formed in the second handle portion and a pin secured to a side of the tang portion and extending transversely into the channel such that pivoting the second handle portion relative to the first handle portion is effective to move the pin within the channel, causing the blade to pivot.

19. The folding knife of claim 17, wherein the blade is substantially enclosed by the first and second handle portions when the blade is in the closed position.

* * * * *